United States Patent [19]

Atkey et al.

[11] Patent Number: 4,637,496

[45] Date of Patent: Jan. 20, 1987

[54] ELEVATOR RAIL SYSTEM

[75] Inventors: Richard E. Atkey, Memphis, Tenn.; Oscar E. Gilliland, Nesbit, Miss.

[73] Assignee: Dover Corporation, New York, N.Y.

[21] Appl. No.: 726,811

[22] Filed: Apr. 25, 1985

[51] Int. Cl.[4] ..... B66B 7/02

[52] U.S. Cl. ..... 187/95; 238/135; 403/292; 403/309

[58] Field of Search ..... 187/95, 6, 1 R; 238/134, 135, 137, 138, 122, 338, 351, 310; 403/292, 293, 298, 309, 313

[56] References Cited

U.S. PATENT DOCUMENTS

| | | | |
|---|---|---|---|
| 2,633,301 | 3/1953 | Eseh | 238/135 |
| 3,088,545 | 5/1963 | Meyer | 187/95 |
| 3,480,309 | 11/1969 | Harris | 403/313 |

FOREIGN PATENT DOCUMENTS

| | | | |
|---|---|---|---|
| 1071307 | 6/1956 | Fed. Rep. of Germany | 187/95 |
| 1102362 | 2/1957 | Fed. Rep. of Germany | 187/95 |
| 588412 | 5/1947 | United Kingdom . | |
| 624185 | 5/1949 | United Kingdom . | |
| 660104 | 10/1951 | United Kingdom . | |
| 804743 | 11/1958 | United Kingdom . | |
| 931127 | 7/1963 | United Kingdom . | |
| 930435 | 7/1963 | United Kingdom . | |
| 1247571 | 9/1971 | United Kingdom . | |
| 1457399 | 12/1976 | United Kingdom . | |
| 2034650 | 6/1980 | United Kingdom . | |

*Primary Examiner*—H. Grant Skaggs
*Assistant Examiner*—Kenneth Noland
*Attorney, Agent, or Firm*—Brumbaugh, Graves, Donohue & Raymond

[57] ABSTRACT

A rail system for elevators includes a plurality of omega-shaped rail sections. Adjacent sections are spliced together by a common tube, projecting into the adjoining hollow sections of rail, which is secured by clamps. The rails are mounted to a building structure by brackets that have a circular portion, engaging the interior space of the rail sections, and projecting portion that can be mounted to the building structure.

18 Claims, 8 Drawing Figures

ELEVATOR RAIL SYSTEM

BACKGROUND OF THE INVENTION

The present invention is an improved elevator rail system and method for constructing and installing the same. .

In elevator systems, a car is vertically displaceable between floor, and is guided for vertical movement in a hoistway. The conventional and industry standard means for guiding an elevator is with a "T" section rail supported from the building structure and sliding shoes or a series of wheels known as roller guides mounted on the car.

A conventional T section rail 10 is shown in FIG. 1 and labelled as "prior art". The guiding surfaces 12, 14 and 16 normally machined to provide a smooth surface and to maintain straightness and proper size. In typical building constructions, the rail system is constructed from a plurality of rail sections, and the end faces between the adjacent rail sections must be carefully machined to assure alignment and structural continuity between rail sections on the respective adjacent surfaces 12, 14 and 16. This is normally done with an interlocking connection between the ends of the respective rails, and a backing plate between rails. As shown in FIG. 1, the top surface 18 of rail 10 is machined to have a tongue 20, which provides an interlocking connection with a corresponding groove machined in the rail section to which section 10 is to be connected. The backing plate 22 bolts to a machined surface 24 on the back of the rail 10 and, when rail sections are joined, is bolted to a similar machined backing surface on the adjacent rail.

This system is functionally adequate and is presently the industry standard for elevator systems. However, this type of system is both expensive to produce and time consuming and costly to install. The high cost of production results from the extensive machining which is required in producing the rail systems, as described above. The installation costs stem from three sources.

First, the rail system must be aligned in three ways: (1) the rails must be aligned plumb (precisely vertical); (2) the rail system must be maintained a precise distance from the rail on the opposite side of the hoistway; and (3) the rail system must be given precise angular alignment relative to the hoistway and relative to the other rail system. In other words, the surfaces 12, 14 and 16 must be oriented at the correct angle relative to the hoistway and opposite rail system for properly receiving the sliding shoes or rollers on the car. This alignment requires the use of expensive support brackets attached to the building structure, ones that will allow freedom of adjustment, and also requires extreme care on the part of the installer.

Second, because a backing plate 22 and multiple bolting are required at the splices between rail sections, these splices take up considerable space in the hoistway. The splices often interfere, or compete for position with, other supports on the building structure.

Third, the need for machined portions at the facing surfaces between rail sections, for example tongue and groove sections formed on respective facing surfaces, greatly limits the use of scrap pieces. When a machined rail section is cut during installation, it will no longer have a properaly machined tongue or groove at the cut end. This creates the need for maintaining a variety of machined lengths and consequently increases the necessary inventory of pieces.

SUMMARY OF THE INVENTION

The present invention is a rail system for elevators which is far less expensive to produce, easier to install and align properly, which has little interfering structure at the splices between rail sections, and which includes a novel bracket mounting system.

In a preferrred structure of the invention, the rail section is omega-shaped in cross-section with one portion being round, and with two protruding flat sections. The round portion defines an internal space which is used both for splicing sections together and for mounting the rails in the elevator hatchway.

Preferably, the splices between sections include a tubular member which projects into the circular portion of each of the adjoining rail sections. One or more clamps are applied to the ends of the flat projections which thereby retain the tubular member securely in place and, in so doing, securely hold the adjacent rail sections relative to one another.

In the preferred mounting system, a bracket member has a circular portion which fits snugly into the circular portion of the omega rail, and projects out through the elongated, open-slot side of the omega rail. The external section of the bracket contains a plurality of slots that allow adjustable bolting to a building structure or other means provided. This bracket is merely inserted into the omega rail section, bolted to the means provided and secured, if desired, with a clamp.

An alternative bracket arrangement includes a "T" portion, with a key slot hole in the leg of the "T", and a disc with a tapered projection at a center that fits into the hole in the T-bracket. When assembled, this latter embodiment has substantially the same structure as the first mentioned bracket arrangement. However, this embodiment has an additional advantage in installation, as described below.

A rail system according to the invention provides guide surfaces at equivalent angles to the T shaped rail presently in use in the industry. However, since the guide surface of the present rail system is circular, twisting of the rail is unimportant to alignment.

Unlike the conventional rail system, there is no machining of the rail system required. The rail sections may readily be formed, in known machines for bending flat metal plate, into the desired cross-sectional configuration. Such machines are readily available and can form the circular rail sections within the required tolerances.

Similarly, there is no machining requirement at the area of the splices. The splices are contained within the rail sections and do not substantially interfere with any other brackets.

The rails, at the splices, are clamped to a common tube, which assures a consistent size and proper alignment at the splices. In addition, any piece of rail may be connected to any other piece, and rail sections may be cut to desired lengths, since no end preparation is required for splicing. In a rail system according to the invention, the rail brackets can resist horizontal loads and still be free to allow vertical motion such as that caused when a building settles or shrinks.

Finally, as described below, the alternative bracket system, with the separatable T and disc portions, greatly facilitates installation and alignment. In the hoistway, by dropping a plumb line and positioning the T brackets so that the line runs through the center of the key slot holes, precise alignment of the rail system is assured before the rail sections are installed. Thereafter, the rails can be installed and secured by inserting the discs, and will be aligned.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 2:
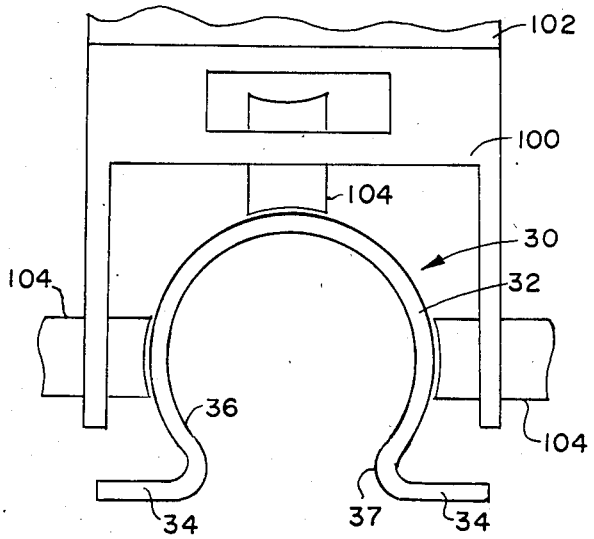
FIG. 2 is a top view of an elevator guide means with a rail system in accordance with the present invention.

As shown in FIG. 2, the preferred cross-sectional configuration of a rail section 30 in accordance with the invention is omega-shaped, having a circular portion 32 and oppositely extending flat portions 34. The flat portions 34 lie in a common plane. The curved portion 32 defines an interior space 36, which is employed as described further on, and an open-slot side 37. The slot 37 runs the length of the rail 30.

Figure 1:
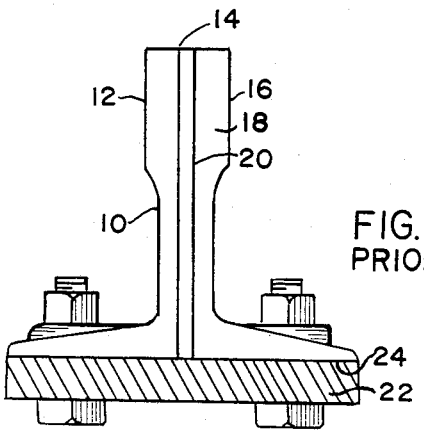
FIG. 1 PRIOR ART
FIG. 1 is a vertical, sectional view of a conventional rail system, taken at a splice between rail sections.

FIG. 2 shows schematically a roller guide assembly 100 mounted to an elevator car 102. The guide assembly may be a conventional 3-roller assembly of the type normally used with the FIG. 1 guide rail. If desired, the roller elements 104 may be curved as shown in FIG. 2. Also, two elements may be used in place of the three shown, one located about halfway between each pair of rollers 104 shown in FIG. 2.

Figure 3:
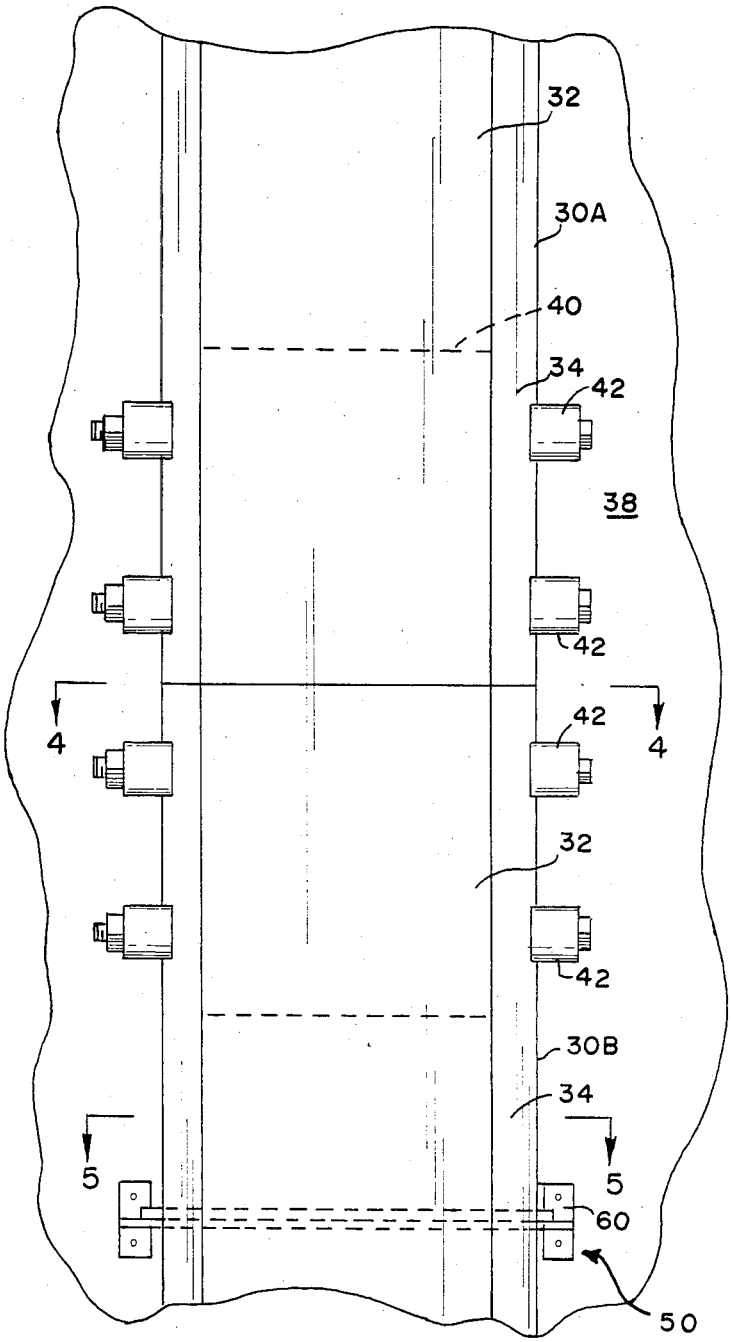
FIG. 3 is a front view of a rail system in accordance with the invention, showing two rail sections spliced together.

FIG. 3 shows a front view of two rail sections 30A and 30B, in accordance with FIG. 2, installed in a hoistway 38. As shown in FIG. 3, the curved section 32 faces away from the hoistway wall 38, and thereby provides a guiding surface corresponding to the guiding surfaces 12, 14 and 16 of the prior art rail section shown in FIG. 1. The sections 30A and 30B are spliced together by a tube 40, which is disposed in the interior space 36 of the rail sections, and by a series of clamps 42 which are shown better in FIG. 4.

Figure 4:
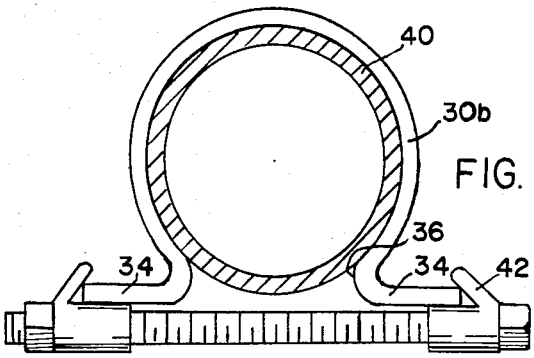
FIG. 4 is a top, sectional view of a splice section of the rail system in accordance with the invention, taken through lines 4—4 of FIG. 3.

FIG. 4 is taken at the splice between rails, and is a top view showing rail section 30B as well as the lower half of the tube 40. As shown, the tube 40 fits snugly within the internal space 36 of the rail section 30B. Each clamp 42 engages the ends of the flat portions 34 to squeeze the rail section 30B around the tube 40 and hold it securely in place. The clamps 42 are provided on either side of the splice, and thus the rail sections are retained securely together.

The splice between rail sections 30A, 30B is a moment connection, and the extending tube 40 thereby provides good bending resistance. If desired, one clamp 42 may be employed for the purpose of holding the tube, however, it is preferably to employ two or more clamps as shown, since the clamps act not only to hold the tube in place, but to hold the rail sections together. In addition, by providing clamps just on either side of the splice, the clamps hold the rail sections on either side of the splice very close to the tube, to assure uniformity in the outside dimension of the circular portion at the interface of the adjacent tube sections, thereby assuring a smooth transition for the roller guides between adjacent tubes at the splices.

Figure 5:
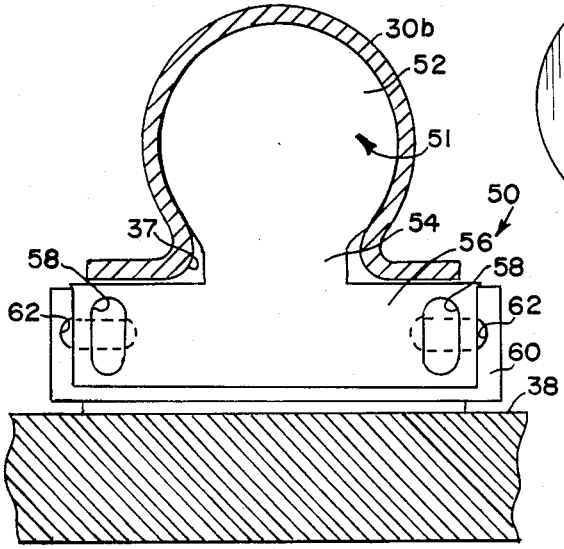
FIG. 5 is a top sectional view of a portion of the rail system in accordance with the invention, showing the mounting system, taken through lines 5—5 of FIG. 3.

Referring again to FIG. 3, below the splice section a rail mounting bracket assembly 50 is shown. A plurality of these assemblies 50 are employed in the hoistway. The system may be better understood with reference to FIG. 5. A bracket plate member 51 has a circular portion 52 which is received in the circular, interior space 36 of the rail section 30B, preferably by a snug fit. The bracket plate 51 includes a projecting neck 54 that extends out through the elongated slot 37 of the omega-shaped rail 30B, and includes an external mounting portion 56 containing spaced elongated slotted mounting holes 58. Preferably, the portion 56 engages the flat portions 34 of the rail 30 to prevent twisting. The mounting portion 56 may be secured to any suitable bracket mounting structure attached or connected to the hoistway wall 38. An exemplary bracket 60 is shown in FIGS. 3 and 5, attached to the hoistway wall 38, and includes transversely elongated slots 62 that mate with slots 58 in the bracket 51. In the arrangement shown, the brackets 51 and 60 may be bolted together, and are provided with universal adjustability in the common plane. Any other suitable connection may be employed.

In the bracket mounting system shown in FIG. 5, the rail mounting system may readily be installed by building up sections from the bottom of the elevator shaft. As is apparent, when a new rail section is to be added, the splice may readily and easily be made in place by inserting and clamping a tube 40 between sections. Also, at desired locations, the mounting bracket 51 can easily be inserted by turning the plate 51 at an angle 90° from that shown in FIG. 5, inserting the circular portion 52 into the circular space 36 of the omega-shaped bracket 30 and thereafter twisting the plate 51 and bolting it as shown in FIG. 5 (similar to inserting a key).

As noted before, in aligning the rail system having rails 30, it is necessary only to assure that the rails are vertical, and that the rails on opposite sides of the hoistway are properly spaced. The angle at which the circular guide surface projects from the wall, i.e. its angle about the vertical axis, is irrelevant, since the active surface 32 is circular. As a result, this system is easily and readily installed in the hoistway.

Figure 6A:
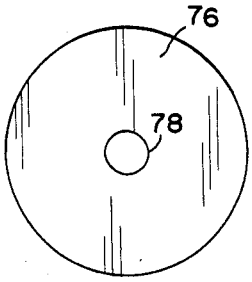
FIGS. 6A and B are top and side views of a disc forming part of an alternative bracket mounting system.
Figure 6B:
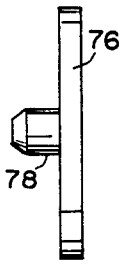
Figure 7:
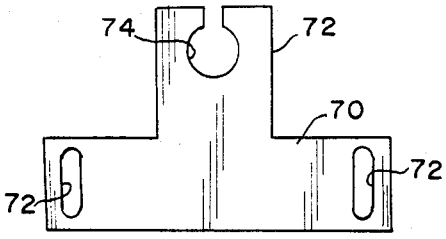
FIG. 7 is a top view of a T plate forming part of the alternative bracket mounting system.

FIGS. 6–7 illustrate an alternative construction of the bracket mounting assembly. In this alternative embodiment, a two-piece bracket assembly is used in place of the single bracket plate 51 shown in FIG. 5.

A T-shaped bracket plate 70 includes a mounting portion with slots 72, which correspond to slots 58 of plate 51, and includes a projecting key portion 72 formed with a key slot hole 74. The other member of the bracket assembly is a disc 76 that has a projecting stud 78, which is preferably tapered as shown in FIG.

6B. The stud 78 fits into key slot hole 74 snugly for securing the parts 76 and 70 together.

The assembly 70, 76 is essentially the same as plate 51 when assembled. The two-piece assembly may be employed when it is desired to install the elevator by pre-aligning the brackets.

In particular, when installing the elevator in a hoistway, the T-shaped bracket portion 70 of FIG. 7 is first installed on a mounting plate, such as mounting plate 60 shown in FIG. 5. A plumb line or "target line" is dropped from the top of the elevator hoistway during installation, and the brackets 70 are positioned so that the plumb line passes precisely through the center of each key slot hole 74. In this manner, each of the T-shaped bracket plates 70 is precisely positioned relative to the plumb line and tightened in position before the rails per se are installed. Thereafter, the rail sections may be installed one on top of the other in hoistway, and at each bracket 70 a disc plate 76 maybe inserted into the space 36 of the rail section, twisted, and engaged with plate 70 to lock the rail in proper vertical alignment.

Other means of attaching parts 76 and 70 may be used. The use of an open slot 74, however, facilitates inserting and withdrawing a plumb line.

In view of the ease of making splices in accordance with the invention, the rail system may easily be installed in place in the hatchway, by connecting one rail section at a time. If desired, however, a length of rail section may be preassembled, regardless of whether using bracket 51 or bracket assembly 70, 76, since in either case, the round portion of the respective bracket assembly can be keyed onto the rail section at any location along the rail.

In the bracket mounting system according to the invention, the rails are retained securely in their horizontal position to withstand horizontal loads of the car. At the same time, since there is no fixed connection, but merely a snug fit, between the round section 52 of bracket 51, or between the disc 76 of the assembly 70, 76, the entire rail system is free to "float" vertically, such as may occur during building settling, while retaining horizontal alignment.

A system according to the invention may be employed in a conventional elevator hoistway, as described herein. It may similarly be used where the car is in an atrium or outside a building, since the rail system readily mounts to any building structure.

The foregoing represents the preferred embodiments of the invention. Variations and modifications of the structure and assembly methods shown and described herein will be apparent to persons skilled in the art, without departing from the inventive principals disclosed herein. All such variations and modifications are intended to be within the scope of the invention as defined in the following claims.

We claim:

1. In an elevator system having a vertically displaceable car, a rail system for guiding said car comprising at least one rail section, omega-shaped in cross-section thereby to have a circular portion defining an interior space and terminating in a pair of oppositely extending flanges, with an elongated slot therebetween running axially the length of the rail section, and mounting means engaging the rail section for mounting the section to a building structure, wherein said mounting means comprises a plurality of bracket means, each having a first bracket portion disposed in the interior space and a second bracket portion extending through said slot to the exterior of the rail section, wherein said first bracket portion is in the form of a substantially flat plate lying at least substantially in a plane transverse to the axis of the rail section and engaging said interior wall at locations for retaining said first bracket portion against movement, relative to said rail section, in said plane, and means engaging said second bracket portion for attaching said bracket means to a building structure.

2. An elevator system as defined in claim 1, wherein the second bracket portion engages said rail flanges for preventing twisting of said rail sections.

3. An elevator system as defined in claim 2, wherein said bracket means includes a disc member conforming to the shape of said interior space and a T-shape bracket member having a section insertable through the rail slot, and means for attaching one member to another.

4. An elevator system as defined in claim 2, wherein said second bracket portion and the means engaging said second bracket portion includes means for adjustably securing such elements to one another in a plane transverse to the rail section axis.

5. An elevator system as defined in claim 4, wherein said first bracket portion is substantially circular to conform to the shape of said interior space.

6. An elevator system as defined in claim 1, including at least one additional rail section having a similar cross-section, wherein said rail sections are arranged in ene-to-end relationship; means for clamping adjoining ends of the rail sections together comprising an element projecting into the interior spaces of adjoining rail sections and engaging the interior surfaces of the adjoining rail sections, and clamping means engaging the opposed flanges on each adjoining rail section for urging said flanges toward one another.

7. An elevator system as defined in claim 6, wherein each rail section has a uniform, omega-shaped cross-section to have a first portion with an outside surface defining a substantial part of a circle, an interior surface defining an interior space, and opposed, spaced end portions; a pair of sharp bend portions, extending from each end portion to an angle substantially tangent to the circle; and a pair of oppositely extending flanges, one extending from each bend portion substantially tangent to the circle, the two bend portions defining an elongated slot therebetween; and wherein said second bracket portion engages said flanges for inhibiting twisting of said rail sections.

8. An elevator system as defined in claim 7, wherein each clamping means includes clamping elements, engaging opposed flanges, adjustable toward and away from one another such that adjacent rail sections can be brought together, and thereafter clamped.

9. An elevator system as defined in claim 8, wherein said first bracket portion is substantially circular to conform to the shape of said interior space.

10. An elevator system as defined in claim 9, wherein said second bracket portion and the means engaging said second bracket portion include means for adjustably securing the elements to one another in a plane transverse to the rail section axis.

11. In an elevator system having a car vertically displaceable, a rail system for guiding said car comprising at least one rail section having a wall portion shaped to define an exterior curved surface and an interior space, said wall portion having ends separated for forming an elongated slot communicating between said interior space and the exterior of said rail section and running axially the length of the rail section, and mounting means for positioning said at least one rail section in the hoistway comprising a plurality of bracket means, each having a first bracket portion disposed in said interior space and a second bracket portion extending through said slot to the exterior of the rail section, wherein said first bracket portion is in the form of a substantially flat plate lying at least substantially in a plane transverse to the axis of the rail section and engaging said interior wall at locations for retaining said first bracket portion against movement, relative to said rail section, in said plane, and means engaging said second bracket portion for attaching said bracket means to a building structure.

12. In an elevator system having a vertically displaceable car, a rail system for guiding said car comprising at least two rail sections, arranged in end-to-end relationship, wherein each rail section has a uniform, omega-shaped cross-section to have a first portion with an outside surface defining a substantial part of a circle, an interior surface defining an interior space, and opposed, spaced end portions; a pair of sharp bend portions, extending from each end portion to an angle substantially tangent to the circle, and a pair of oppositely extending flanges, one extending from each bend portion substantially tangent to the circle, and two bend portions defining an elongated slot therebetween running axially the length of the rail section;

means for clamping adjoining ends of rail sections together comprising an element projecting into the interior spaces of adjoining rail sections and engaging the interior surfaces of the adjoining rail sections, and clamping means engaging the opposed flanges on each adjoining rail section for urging said flanges toward one another, along the tangent, around the element, wherein each clamping means includes clamping elements engaging opposed flanges, adjustable toward and away from one another such that adjacent rail sections can be brought together, and thereafter clamped, and whereby the clamping means provides a continuous smooth outer surface on the adjoining, circular outside surfaces; and mounting means for engaging at least one of the rail sections for mounting the rail system to a building structure.

13. A method of constructing a rail system for guiding an elevator car, comprising the steps of:

(a) providing at least one rail section having a wall, the wall having an exterior curved surface, an interior surface defining an interior space, and separated end portions forming an elongated slot communicating between said interior space and the exterior of said rail section;

(b) providing at least one bracket member having a first bracket portion in the form of a substantially flat plate shaped, when oriented to lie in a plane transverse to the length of said rail section, to engage said interior surface at locations for retaining said first bracket portion against movement relative to said rail section, said bracket member further including a second bracket portion shaped to extend through said slot to the exterior of the rail section;

(c) positioning said rail section adjacent a building structure;

(d) inserting the first portion of the bracket member into the interior portion of the rail section and orienting said bracket member such that said first portion engages said interior surface and said second bracket portion extends through said slot; and (e) attaching said second bracket portion to said building structure.

14. A method as defined in claim 13, wherein said bracket member is inserted into the interior of the rail section by twisting said first bracket portion to be substantially vertical, and wherein, once inserted, said first bracket portion is turned so as to be substantially horizontal and engage said interior surface.

15. A method as defined in claim 14, wherein said rail section is omega-shaped in cross-section thereby having a pair of oppositely extending flanges porjecting from the end portions of said wall, and wherein said second bracket portion is shaped to engage said flanges for preventing twisting of said rail section.

16. A method as defined in claim 15, comprising further the steps of providing at least one additional rail section, the two rail sections having substantially similar cross-sections; arranging said sections in end-to-end relationship; inserting an element into the interior spaces of the adjacent sections, which element engages the interior surfaces of the adjoining rail sections and aligns the rail sections to provide a continuous, smooth outer surface on the adjoining rail sections; and clamping together the oppositely extending flanges on each of the adjoining rail sections, to clamp the element inside the interior spaces.

17. A method as defined in claim 16, wherein the rail system is installed by (a) providing a two-part mounting bracket including a disc member conforming to the interior of the rail sections and having a projection, and a second bracket piece capable of projecting into the interior of the rail sections, the second portion having an opening for receiving the projection of the disc, (b) mounting a plurality of the second bracket pieces to the building structure and aligning the same, (c) thereafter, positioning the rail sections, inserting the disc members into the interior of the rail sections, and engaging the disc sections with respective second bracket pieces by engaging the relative openings and projections thereof.

18. A method as defined in claim 16, wherein the rail system is installed by (a) mounting the first of the rail sections to a building structure, utilizing at least one bracket member; and (b) thereafter mounting the second of the rail sections over the first rail section, in end-to-end relationship; and (c) inserting a second bracket member into the interior space of the second rail section, positioning the second bracket member to engage the interior surface of the second rail section, and mounting the second bracket member to the building structure.

* * * * *